US009175854B2

(12) United States Patent
Davis, Jr.

(10) Patent No.: US 9,175,854 B2
(45) Date of Patent: Nov. 3, 2015

(54) FLAMELESS LIGHTER

(76) Inventor: Kenneth Gene Davis, Jr., Fontana, CA (US)

( * ) Notice: Subject to any disclaimer, the term of this patent is extended or adjusted under 35 U.S.C. 154(b) by 570 days.

(21) Appl. No.: 13/615,582

(22) Filed: Sep. 13, 2012

(65) Prior Publication Data

US 2013/0062335 A1 Mar. 14, 2013

Related U.S. Application Data

(60) Provisional application No. 61/534,296, filed on Sep. 13, 2011.

(51) Int. Cl.
*H05B 1/02* (2006.01)
*F23Q 7/16* (2006.01)

(52) U.S. Cl.
CPC ..... *F23Q 7/16* (2013.01)

(58) Field of Classification Search
CPC ..... F23Q 7/16; F23Q 7/00; F23Q 7/14; F23Q 7/32; H05B 3/10; H05B 3/18; H05B 3/48
USPC ..... 219/507, 494, 502, 260, 262, 267, 268, 219/270; 431/256, 263
See application file for complete search history.

(56) References Cited

U.S. PATENT DOCUMENTS

| | | | | |
|---|---|---|---|---|
| 4,023,928 | A * | 5/1977 | Haensel | 422/49 |
| 5,454,657 | A * | 10/1995 | Kim | 401/195 |
| 7,586,063 | B1 * | 9/2009 | Wilbon | 219/268 |
| 7,658,520 | B2 * | 2/2010 | Opolka | 362/488 |
| 7,704,071 | B2 * | 4/2010 | Liu et al. | 431/253 |
| 2007/0045276 | A1 * | 3/2007 | Fisher et al. | 219/268 |
| 2008/0289958 | A1 * | 11/2008 | Kardokus et al. | 204/298.12 |
| 2012/0193343 | A1 * | 8/2012 | Johnson | 219/270 |

* cited by examiner

*Primary Examiner* — Mark Paschall

(57) ABSTRACT

A flameless lighter provides a user with a heat source that is similar to typical lighter. The flameless light comprises an enclosure, a slidable switch, a light assembly, a portable power supply, and a switch retraction mechanism. The enclosure is the primary structural component of the flameless lighter. The light assembly is used to produce the necessary heat to ignite items such as cigarettes and candle wicks. The slidable switch is used to activate and deactivate the light assembly and is used to protrude and retract a light bulb into and out of the enclosure. The portable power supply is used electrically power the light assembly and can be recharged through a universal serial bus charging port. The switch retraction mechanism defaults the slidable switch to the "OFF" position so that the flameless light is not left in the "ON" position. This improves the overall safety of the flameless light.

15 Claims, 6 Drawing Sheets

FLAMELESS LIGHTER

The current application claims a priority to the U.S. Provisional Patent application Ser. No. 61/534,296 filed on Sep. 13, 2011.

FIELD OF THE INVENTION

The present invention relates generally to an apparatus for a lighter. More particularly, the present invention is a battery-powered flameless lighter, which eliminates the need for harsh chemicals such as butane and other lighter fuels.

BACKGROUND OF THE INVENTION

Typical lighters contain butane, a highly flammable and liquefied gas which when misused can be dangerous to the point of causing death. Because it is so easily obtained, the large accounts of its misuse has caused much concern in various societies, particularly in the UK. According to the Department of Public Health Sciences, butane is the most commonly misused volatile substance in the UK, causing 52% of "solvent related" deaths in 2000. Given the ease of access to butane and related products such as lighters, it is evident that efforts to reduce its availability via lighters need to increase.

It is therefore an object of the present invention to introduce a flameless lighter which eliminates the use of butane and replaces it with a battery-powered light bulb, capable of producing equivalent amounts of heat. By eliminating the need of harsh chemicals such as butane and other lighter fuels, a smoker can enjoy a clean, pure flavor of his or her smoking product. It is a further object of the present invention to be wind resistant, chemical-free, portable, and capable of being used just like any standard lighter.

DETAILED DESCRIPTIONS OF THE INVENTION

All illustrations of the drawings are for the purpose of describing selected versions of the present invention and are not intended to limit the scope of the present invention.

Figure 2:
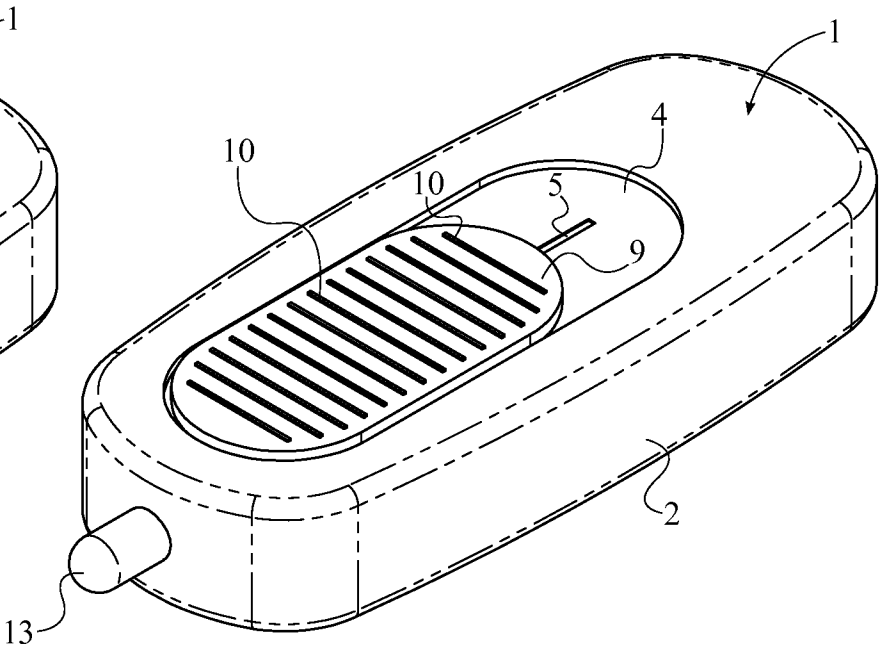
FIG. 2 is a front-perspective view of the preferred embodiment, demonstrating the switch in the "ON" position and exposing a light bulb.
Figure 1:
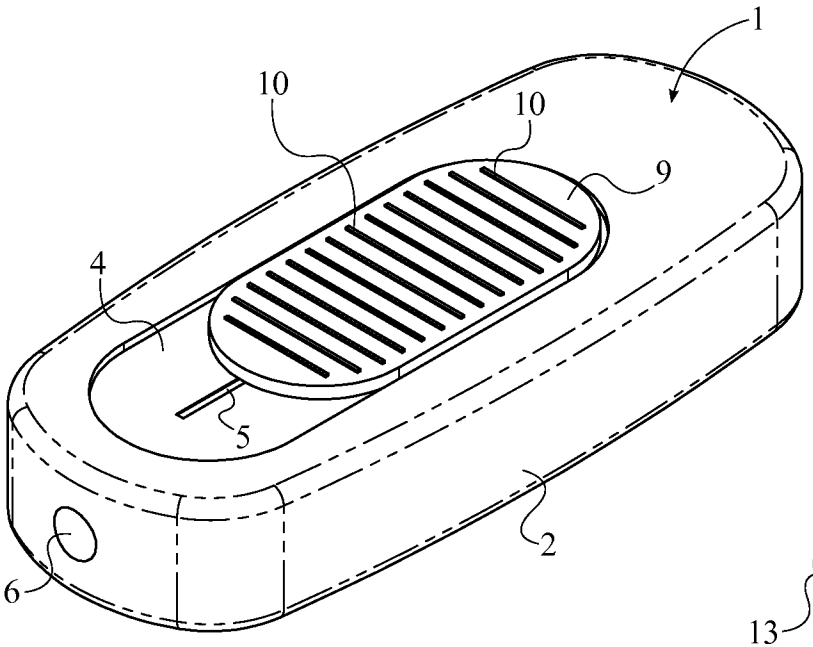
FIG. 1 is a front-perspective view of a case and a switch of the preferred embodiment of the present invention, demonstrating the switch in the "OFF" position.
Figure 4:
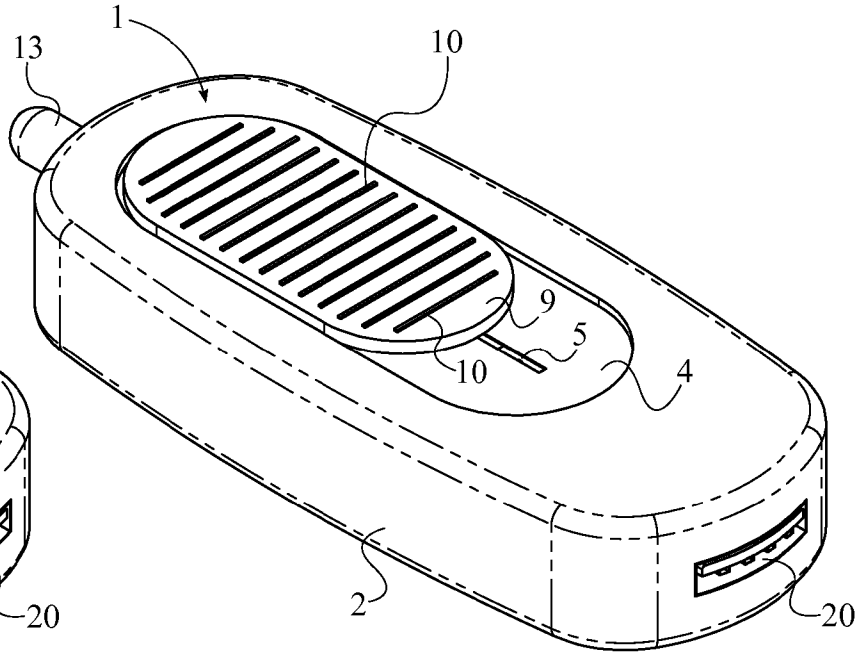
FIG. 4 is a rear-perspective view of the preferred embodiment, demonstrating the switch in the "ON" position.
Figure 3:
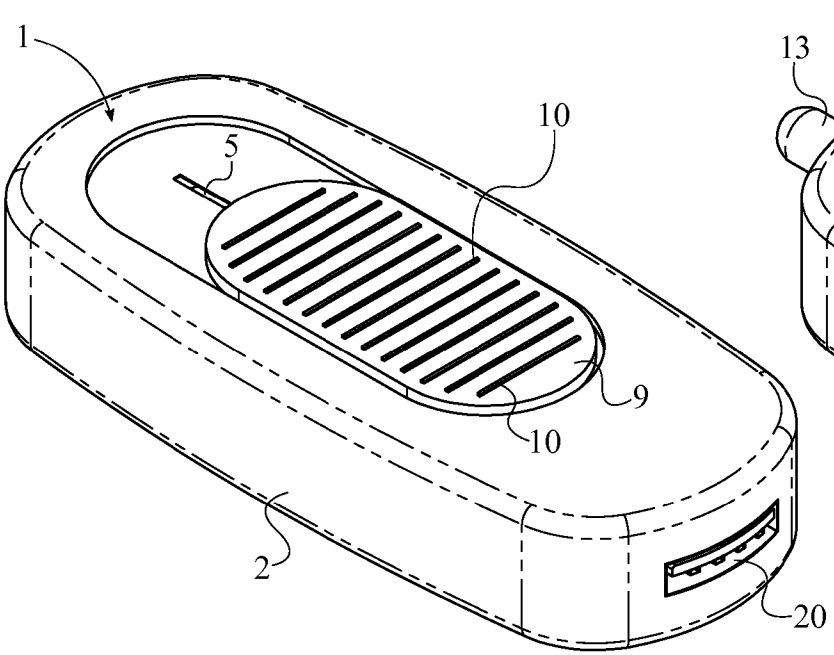
FIG. 3 is a rear-perspective view of the preferred embodiment, demonstrating the switch in the "OFF" position and showing a USB port.
Figure 5:
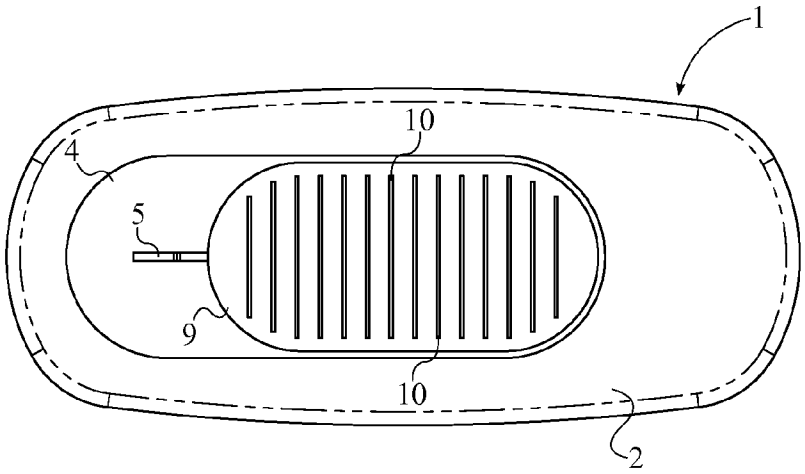
FIG. 5 is a top plan view of the preferred embodiment, demonstrating the switch in the "OFF" position.
Figure 6:
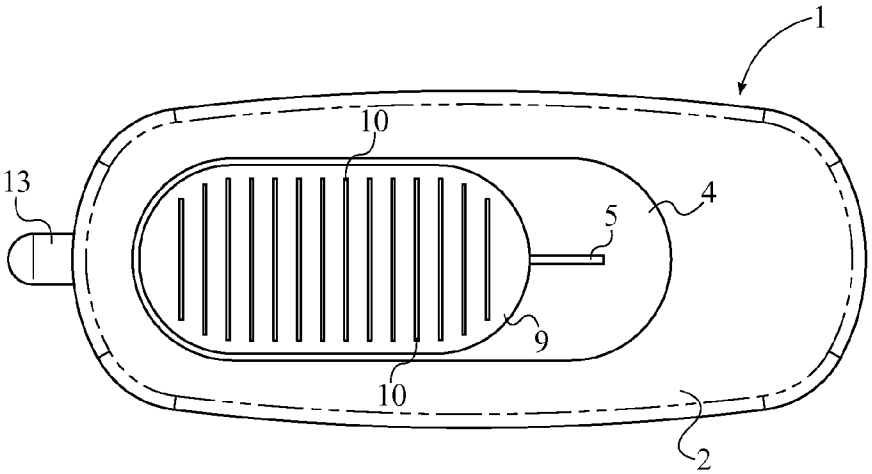
FIG. 6 is a top plan view of the preferred embodiment, demonstrating the switch in the "ON" position.
Figure 7:
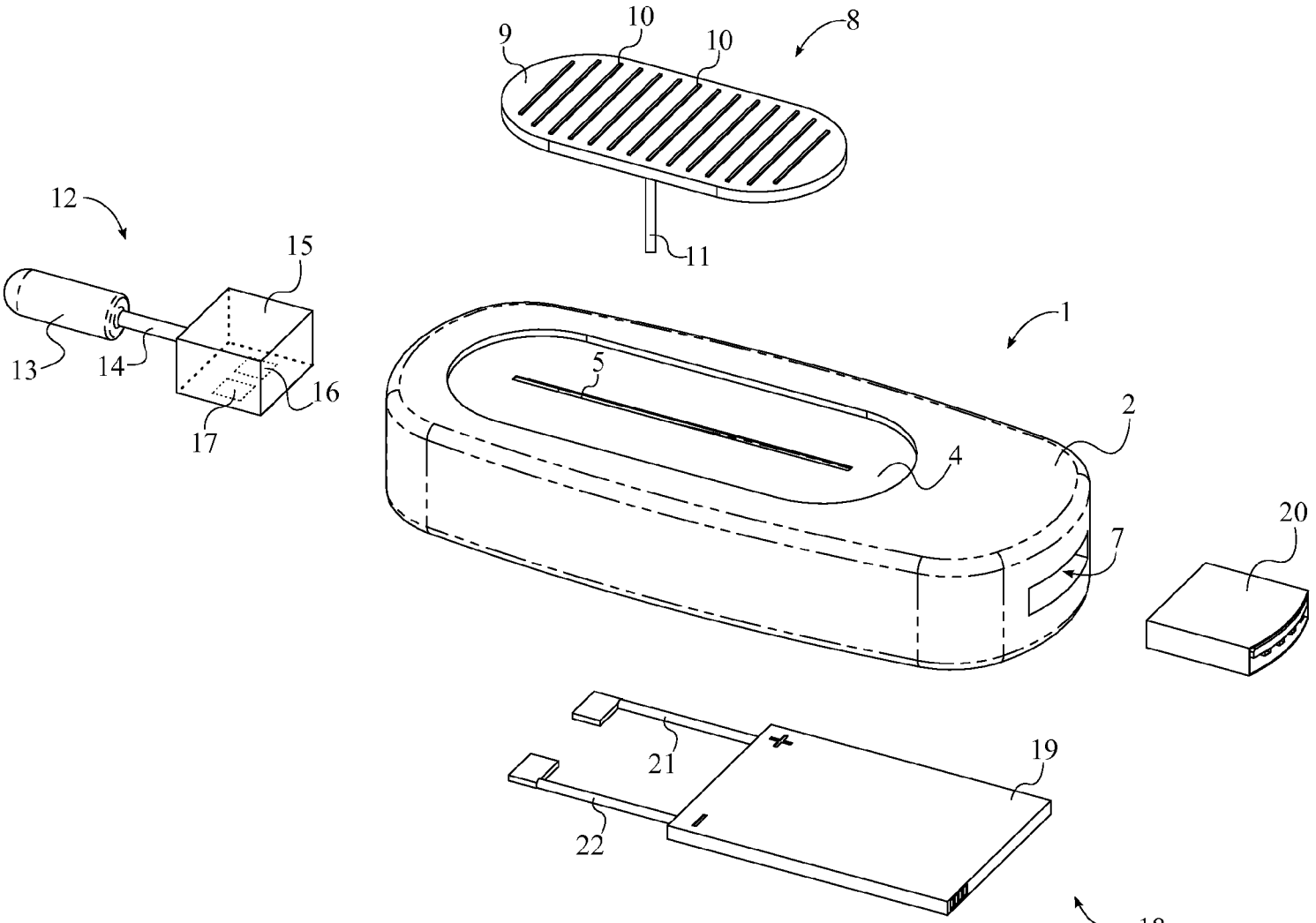
FIG. 7 is an exploded view of the preferred embodiment.
Figure 8:
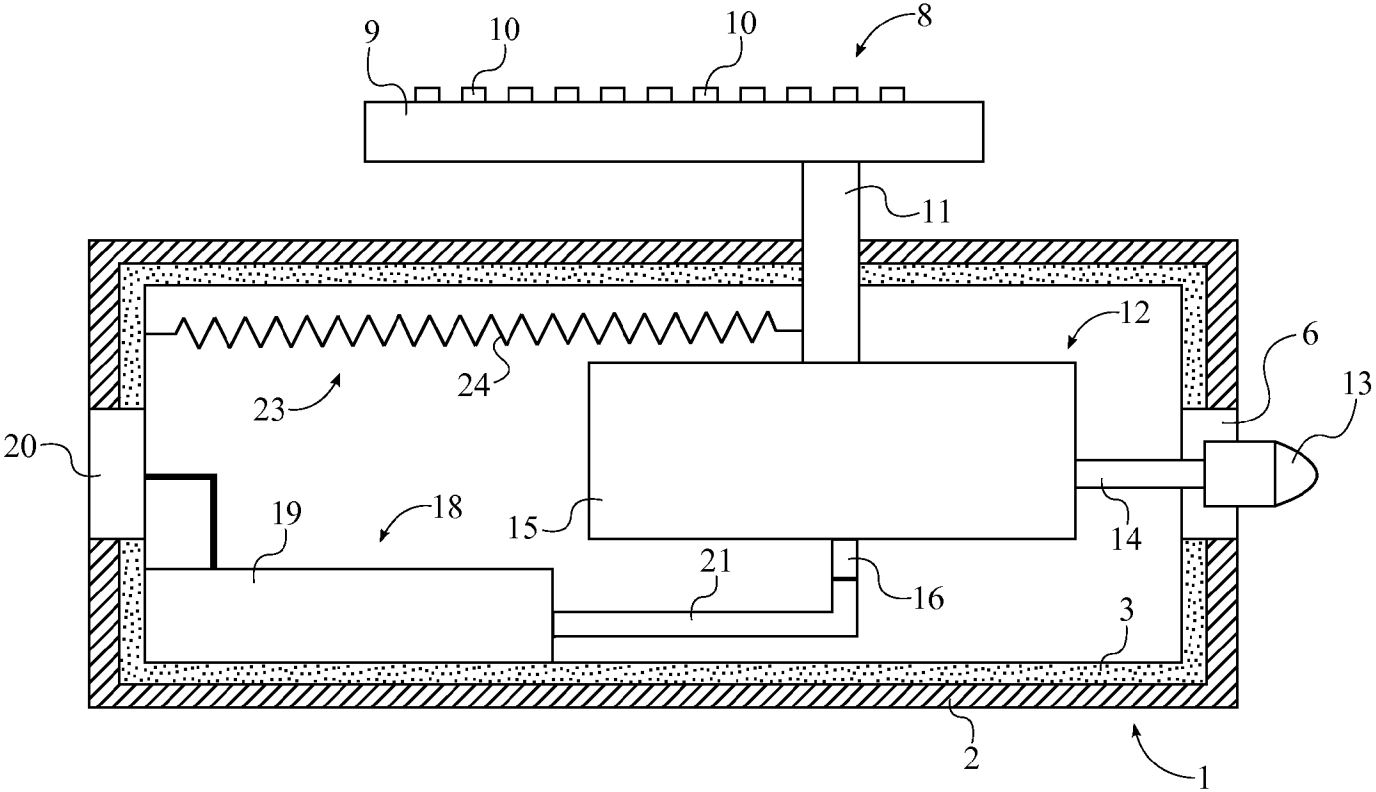
FIG. 8 is a schematic side view of the present invention in the "ON" position.
Figure 9:
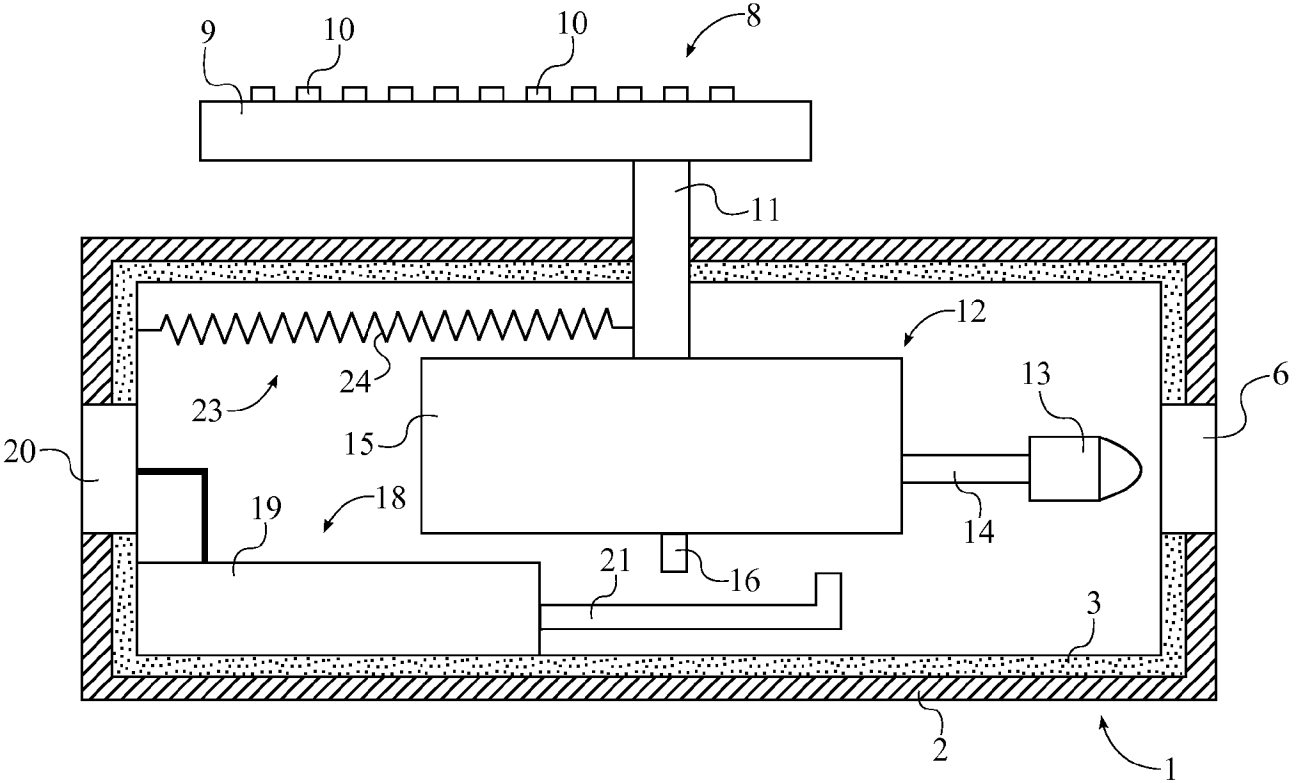
FIG. 9 is a schematic side view of the present invention in the "OFF" position.

The present invention is a flameless lighter, which is used to produce heat that is equivalent to a flame lighter. The present invention is depicted in FIG. 1-5 in both the "OFF" position and the "ON" position. The heat source for the present invention is a battery-power light bulb that can be used to ignite smoking products, candles, campfires, and etc. As can be seen in FIG. 7-9, the present invention comprises an enclosure 1, a slidable switch 8, a light assembly 12, a portable power supply 18, and a switch retraction mechanism 23. The enclosure 1 is used as a means to encapsulate the other components of the present invention. The slidable switch 8 allows a user to activate the light assembly 12, which is used to produce heat like a flame lighter. The portable power supply 18 is used to electrically power the light assembly 12 so that the light assembly 12 can produce the required heat. The switch retraction mechanism 23 returns the slidable switch 8 to a default off position so that the light assembly 12 does not stay continuously activated.

The user can activate or deactivate the light assembly 12 by moving the slidable switch 8 between an "OFF" position and an "ON" position. The slidable switch 8 comprises a thumb tab 9, a plurality of gripping ridges 10, and a guide protrusion 11. The thumb tab 9 is ergonomically designed so that the user can easily move the slidable switch 8 with their thumb. The plurality gripping ridges 10 is connected across the thumb tab 9. The plurality of gripping ridges 10 provides the user's thumb with more friction against the thumb tab 9, which also allows the user to more easily move the slidable switch 8 with their thumb. The guide protrusion 11 is connected normal to the thumb tab 9 opposite to the plurality of gripping ridges 10 and is used as the physical connection between the slidable switch 8 and the light assembly 12.

The enclosure 1 defines the overall shape of the present invention and is the primary structural component of the present invention. The enclosure 1 comprises an outer shell 2, an insulating material, a recessed track 4, a guide slit 5, a bulb hole 6, and a port hole 7. The outer shell 2 provides the enclosure 1 with structural rigidity and is made of metal in the preferred embodiment of the present invention. The insulating layer 3 is used to prevent heat from damaging the internal components of the present invention. Consequently, the insulating layer 3 is connected within and across the outer shell 2. The bulb hole 6 and the port hole 7 are positioned opposite to each other along the enclosure 1. The bulb hole 6 and the port hole 7 are also positioned laterally along the enclosure 1, which allows the recessed track 4 to be positioned atop the enclosure 1. The recessed track 4 is used to guide the movement of the thumb tab 9 along the enclosure 1 between the "OFF" position and the "ON" position. Thus, the thumb tab 9 is positioned within the recessed track 4. The guide slit 5 is positioned along the recessed track 4 and traverses through both the outer shell 2 and the insulating layer 3. For the slidable switch 8, the guide protrusion 11 traverses through the guide slit 5 and connects to the light assembly 12, which allows the light assembly 12 to mimic the movement of the thumb tab 9 sliding along the recessed track 4.

The light assembly 12 produces heat outside of the enclosure 1, but most of the components for the light assembly 12 are usually located within the enclosure 1. The light assembly 12 comprises a large heat producing light bulb 13, an extension arm 14, and a circuit board 15. The circuit board 15 is used to regulate the amount of heat being produced by the light bulb 13. The circuit board 15 is positioned within the enclosure 1, which allows the circuit board 15 to be connected normal to the guide protrusion 11 opposite to the thumb tab 9. The circuit board 15 also comprises a bulb positive terminal 16 and a bulb negative terminal 17. The bulb positive terminal 16 and the bulb negative terminal 17 allow the light assembly 12 to receive electrical power from the portable power supply 18. The bulb positive terminal 16 and the bulb negative terminal 17 are positioned opposite to the guide protrusion 11 on the circuit board 15 and are positioned adjacent to each other. This configuration for the bulb positive terminal 16 and the bulb negative terminal 17 allows the light assembly 12 to electrically connect to the portable power supply 18. Also for this configuration, the extension arm 14 is laterally connected to the circuit board 15 and is positioned towards the bulb hole 6. The light bulb 13 is then connected to the extension arm 14 opposite to the circuit board 15. In addition, both the extension arm 14 and the light bulb 13 are concentrically position with the bulb hole 6. From the "OFF" position, the configuration for the extension arm 14 and the light bulb 13 allows the extension arm 14 to force the light bulb 13 through the bulb hole 6 and out of the enclosure 1 when the user pushes the thumb tab 9 towards the bulb hole 6 in order to move the slidable switch 8 to the "ON" position shown in FIG. 8. From the "ON" position, the configuration for the extension arm 14 and the light bulb 13 allows the extension arm 14 to force the light bulb 13 back through the bulb hole 6 and into the enclosure 1 when the user pulls the thumb tab 9 towards the port hole 7 in order to move the slidable switch 8 to the "OFF" position shown in FIG. 9. In the preferred embodiment of the present invention, the light bulb 13 is specifically a halogen light bulb 13. In another embodiment of the present invention, the light bulb 13 may be similar to the one found in a small flashlight, possibly tinted or colored reducing its brightness so that it is not harsh on the eyes of the user.

The portable power supply 18 is securely positioned within the enclosure 1 so that the light assembly 12 can move to electrically engage the portable power supply 18. The portable power supply 18 comprises a battery pack 19, a universal serial bus (USB) charging port 20, an extending positive contact 21, and an extending negative contact 22. The battery pack 19 provides the electrical energy that is converted into thermal energy by the light bulb 13. The battery pack 19 can be, but is not limited to, a regular or lithium battery. The battery pack 19 is located opposite the recessed track 4 with the enclosure 1 so that the battery pack 19 does not impede the movement of the light assembly 12. The battery pack 19 is connected to the enclosure 1 adjacent to the port hole 7, which also prevent the battery pack 19 from impeding the movement of the light assembly 12. The USB charging port 20 allows the user to recharge the battery pack 19 through any typical USB connection. The USB charging port 20 also provides electrical power to the light assembly 12 if the battery pack 19 is not fully charged. The USB charging port 20 is positioned within and is connected to the port hole 7. The extending positive contact 21 and the extending negative contact 22 allow the portable power supply 18 to supply electrical power to the light assembly 12. The extending positive contact 21 and the extending negative contact 22 are positioned adjacent to each other. In addition, the extending positive contact 21 and the extending negative contact 22 are positioned adjacent to the bulb hole 6 so that both the bulb positive terminal 16 electrically engages the extending positive contact 21 and the bulb negative terminal 17 electrically engages the extending negative contact 22 when the light bulb 13 protrudes through the bulb hole 6. Once the bulb positive terminal 16 and the bulb negative terminal 17 electrically engage the extending positive contact 21 and the extending negative contact 22, the circuit between battery pack 19 and the light bulb 13 is complete, which allows the light bulb 13 to be activated. After a few seconds, the light bulb 13 is heated so that any cigar, cigarette, pipe tobacco, dried leaves, candle wick, BBQ, etc. can be ignited.

The electrical connections and the configuration of certain components allow the present invention to activate the light bulb 13 when the slidable switch 8 is in the "ON" position and to deactivate the light bulb 13 when the slidable switch 8 is the "OFF" position. The USB charging port 20 is electrically connect to the battery pack 19 so that the USB charging port 20 can recharge the battery pack 19. The extending positive contact 21 and the extending negative contact 22 is electrically connected the battery pack 19 so that the extending positive contact 21 and the extending negative contact 22 can deliver electrically power from either the USB charging port 20 or the battery pack 19 to the light assembly 12. For this configuration, the extending positive contact 21 is positioned to be inline with the bulb positive terminal 16, and the extending negative contact 22 is positioned to be inline with the bulb negative terminal 17, which allows the extending positive contact 21 and the extending negative contact 22 to more easily engage and disengage from the bulb positive terminal 16 and the bulb negative terminal 17 while switching between the "ON" position and the "OFF" position. The bulb positive terminal 16 and the bulb negative terminal 17 are electrically connected to light bulb 13 so that the bulb positive terminal 16 and the bulb negative terminal 17 can deliver electrical power to the light bulb 13.

The present invention can optionally comprise a switch retraction mechanism 23, which is used to default the slidable switch 8 into the "OFF" position. In one embodiment, the switch retraction mechanism 23 comprises only a spring 24, which would have a first end and a second end. The first end of the spring 24 would be connected to the guide protrusion 11 opposite to the extension arm 14, and the second end of the spring 24 would be connected to the enclosure 1 adjacent to the port hole 7. This configuration of the spring 24 would pull the slidable switch 8 towards the "OFF" position so that the light bulb 13 would automatically deactivate once the user stopped pushing against the thumb tab 9. Thus, the user is able to turn off the light bulb 13 simply by releasing the slidable switch 8. The switch retraction mechanism 23 would increase the overall safety of the present invention.

Although the invention has been explained in relation to its preferred embodiment, it is to be understood that many other possible modifications and variations can be made without departing from the spirit and scope of the invention as hereinafter claimed.

What is claimed is:

1. A flameless lighter comprises, an enclosure;

a slidable switch;

a light assembly;

a portable power supply;

a switch retraction mechanism;

said enclosure comprises an outer shell, an thermally insulating layer, a recessed track, a guide slit, a bulb hole, and a port hole;

said slidable switch comprises a thumb tab, a plurality of gripping ridges, and a guide protrusion;

said light assembly comprises a heat producing light bulb, an extension arm, and a circuit board;

said portable power supply comprises a battery pack, a universal serial bus (USB) charging port, an extending positive contact, and an extending negative contact;

said circuit board comprises a bulb positive terminal and a bulb negative terminal;

said thermally insulating layer being connected within and across said outer shell;

said extension arm, said circuit board, said battery pack, said extending positive contact, said extending negative contact being located within said thermally insulating layer;

said bulb hole and said port hole being positioned opposite to each other along said enclosure;

said bulb hole and said port hole being laterally located on said enclosure;

said recessed track being positioned atop said enclosure;

said guide slit being positioned along said recessed track; and said guide slit traversing through said outer shell and said thermally insulating layer.

2. The flameless lighter as claimed in claim 1 comprises, said thumb tab being positioned within said recessed track;

said guide protrusion being connected normal to said thumb tab;

said guide protrusion traversing through said guide slit; and said plurality of gripping ridges being connected across said thumb tab opposite to said guide protrusion.

3. The flameless lighter as claimed in claim 1 comprises, said circuit board being positioned within said enclosure;

said circuit board being connected normal to said guide protrusion opposite to said thumb tab;

said bulb positive terminal and said bulb negative terminal being positioned opposite to said guide protrusion on said circuit board; and said bulb positive terminal and said bulb negative terminal being positioned adjacent to each other.

4. The flameless lighter as claimed in claim 1 comprises, said extension arm being laterally connected to said circuit board and being positioned towards said bulb hole;

said heat producing light bulb being connected to said extension arm opposite to said circuit board; and said heat producing light bulb and said extension arm being concentrically positioned to said bulb hole, wherein said heat producing light bulb being able to traversing into and out of said bulb hole.

5. The flameless lighter as claimed in claim 1 comprises, said battery pack being located opposite to said recessed track within said enclosure;

said battery pack being connected to said enclosure adjacent to said port hole;

said USB charging port being positioned within and connected to said port hole;

said extending positive contact and said extending negative contact being positioned adjacent to said bulb hole; and said extending positive contact and said extending negative contact being positioned adjacent to each other.

6. The flameless lighter as claimed in claim 1 comprises, said USB charging port being electrically connected to said battery pack;

said extending positive contact and said extending negative contact being electrically connected to said battery pack;

said extending positive contact being positioned inline with said bulb positive terminal;

said extending negative contact being positioned inline with said bulb negative terminal; and said bulb positive terminal and said bulb negative terminal being electrically connected to said heat producing light bulb.

7. The flameless lighter as claimed in claim 6, wherein said heat producing light bulb is activated as said bulb positive terminal electrically engages said extending positive contact and as said bulb negative terminal electrically engages said extending negative contact.

8. The flameless lighter as claimed in claim 1 comprises, said switch retraction mechanism comprises a spring;

a first end of said spring being connected to said circuit board opposite to said extension arm; and a second end of said spring being connected to said enclosure adjacent to said port hole.

9. A flameless lighter comprises, an enclosure;

a slidable switch;

a light assembly;

a portable power supply;

a switch retraction mechanism;

said enclosure comprises an outer shell, a thermally insulating layer, a recessed track, a guide slit, a bulb hole, and a port hole;

said slidable switch comprises a thumb tab, a plurality of gripping ridges, and a guide protrusion;

said light assembly comprises a heat producing light bulb, an extension arm, and a circuit board;

said portable power supply comprises a battery pack, a universal serial bus (USB) charging port, an extending positive contact, and an extending negative contact;

said circuit board comprises a bulb positive terminal and a bulb negative terminal;

said thermally insulating layer being connected within and across said outer shell;

said extension arm, said circuit board, said battery pack, said extending positive contact, said extending negative contact being located within said thermally insulating layer;

said bulb hole and said port hole being positioned opposite to each other along said enclosure;

said bulb hole and said port hole being laterally located on said enclosure;

said recessed track being positioned atop said enclosure;

said guide slit being positioned along said recessed track;

said guide slit traversing through said outer shell and said thermally insulating layer;

said thumb tab being positioned within said recessed track;

said guide protrusion being connected normal to said thumb tab;

said guide protrusion traversing through said guide slit;

said plurality of gripping ridges being connected across said thumb tab opposite to said guide protrusion;

said circuit board being positioned within said enclosure;

said circuit board being connected normal to said guide protrusion opposite to said thumb tab;

said bulb positive terminal and said bulb negative terminal being positioned opposite to said guide protrusion on said circuit board;

said bulb positive terminal and said bulb negative terminal being positioned adjacent to each other;

said extension arm being laterally connected to said circuit board and being positioned towards said bulb hole;

said heat producing light bulb being connected to said extension arm opposite to said circuit board; and said heat producing light bulb and said extension arm being concentrically positioned to said bulb hole, wherein said heat producing light bulb being able to traversing into and out of said bulb hole.

10. The flameless lighter as claimed in claim 9 comprises, said battery pack being located opposite to said recessed track within said enclosure;

said battery pack being connected to said enclosure adjacent to said port hole;

said USB charging port being positioned within and connected to said port hole;

said extending positive contact and said extending negative contact being positioned adjacent to said bulb hole; and said extending positive contact and said extending negative contact being positioned adjacent to each other.

11. The flameless lighter as claimed in claim 9 comprises, said USB charging port being electrically connected to said battery pack;

said extending positive contact and said extending negative contact being electrically connected to said battery pack;

said extending positive contact being positioned inline with said bulb positive terminal;

said extending negative contact being positioned inline with said bulb negative terminal;

said bulb positive terminal and said bulb negative terminal being electrically connected to said heat producing light bulb; and wherein said heat producing light bulb is activated as said bulb positive terminal electrically engages said extending positive contact and as said bulb negative terminal electrically engages said extending negative contact.

12. The flameless lighter as claimed in claim 9 comprises, said switch retraction mechanism comprises a spring;

a first end of said spring being connected to said circuit board opposite to said extension arm; and a second end of said spring being connected to said enclosure adjacent to said port hole.

13. A flameless lighter comprises, an enclosure;

a slidable switch;

a light assembly;

a portable power supply;

a switch retraction mechanism;

said enclosure comprises an outer shell, a thermally insulating layer, a recessed track, a guide slit, a bulb hole, and a port hole;

said slidable switch comprises a thumb tab, a plurality of gripping ridges, and a guide protrusion;

said light assembly comprises a heat producing light bulb, an extension arm, and a circuit board;

said portable power supply comprises a battery pack, a universal serial bus (USB) charging port, an extending positive contact, and an extending negative contact;

said circuit board comprises a bulb positive terminal and a bulb negative terminal;

said thumb tab being positioned within said recessed track;

said guide protrusion being connected normal to said thumb tab;

said guide protrusion traversing through said guide slit;

said plurality of gripping ridges being connected across said thumb tab opposite to said guide protrusion;

said circuit board being positioned within said enclosure;

said circuit board being connected normal to said guide protrusion opposite to said thumb tab;

said bulb positive terminal and said bulb negative terminal being positioned opposite to said guide protrusion on said circuit board;

said bulb positive terminal and said bulb negative terminal being positioned adjacent to each other;

said extension arm being laterally connected to said circuit board and being positioned towards said bulb hole;

said heat producing light bulb being connected to said extension arm opposite to said circuit board;

said heat producing light bulb and said extension arm being concentrically positioned to said bulb hole, wherein said heat producing light bulb being able to traversing into and out of said bulb hole;

said USB charging port being electrically connected to said battery pack;

said extending positive contact and said extending negative contact being electrically connected to said battery pack;

said extending positive contact being positioned inline with said bulb positive terminal;

said extending negative contact being positioned inline with said bulb negative terminal;

said bulb positive terminal and said bulb negative terminal being electrically connected to said heat producing light bulb; and wherein said heat producing light bulb is activated as said bulb positive terminal electrically engages said extending positive contact and as said bulb negative terminal electrically engages said extending negative contact.

14. The flameless lighter as claimed in claim 13 comprises, said thermally insulating layer being connected within and across said outer shell;

said extension arm, said circuit board, said battery pack, said extending positive contact, said extending negative contact being located within said thermally insulating layer;

said bulb hole and said port hole being positioned opposite to each other along said enclosure;

said bulb hole and said port hole being laterally located on said enclosure;

said recessed track being positioned atop said enclosure;

said guide slit being positioned along said recessed track;

said guide slit traversing through said outer shell and said thermally insulating layer;

said battery pack being located opposite to said recessed track within said enclosure;

said battery pack being connected to said enclosure adjacent to said port hole;

said USB charging port being positioned within and connected to said port hole;

said extending positive contact and said extending negative contact being positioned adjacent to said bulb hole; and said extending positive contact and said extending negative contact being positioned adjacent to each other.

15. The flameless lighter as claimed in claim 13 comprises, said switch retraction mechanism comprises a spring;

a first end of said spring being connected to said circuit board opposite to said extension arm; and a second end of said spring being connected to said enclosure adjacent to said port hole.

* * * * *